US006266848B1

(12) United States Patent
Fraccaro et al.

(10) Patent No.: US 6,266,848 B1
(45) Date of Patent: Jul. 31, 2001

(54) HINGE

(75) Inventors: Georg Fraccaro, Zwischenwasser; Marco Rücker, Hohenems, both of (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 0 days.

(21) Appl. No.: 09/379,899

(22) Filed: Aug. 24, 1999

(30) Foreign Application Priority Data

Aug. 25, 1998 (AT) ..... 1441/98
Sep. 4, 1998 (AT) ..... 1502/98

(51) Int. Cl.[7] ..... E05D 7/04; E05D 7/10
(52) U.S. Cl. ..... 16/245; 16/241
(58) Field of Search ..... 16/240, 242, 245, 16/246, 258, 271, 272, 757

(56) References Cited

U.S. PATENT DOCUMENTS 4,800,621 * 1/1989 Röck et al. ..... 16/241 X
5,056,189 * 10/1991 Brüstle et al. ..... 16/258 X
5,245,727 * 9/1993 Sasaki ..... 16/258
5,611,113 3/1997 Röck et al. .
5,937,479 * 8/1999 Ohshima et al. ..... 16/258 X
6,032,333 * 3/2000 Brüstle ..... 16/245 X
6,088,879 * 7/2000 Gasser ..... 16/258 X

FOREIGN PATENT DOCUMENTS 393 405 10/1991 (AT) .
38 41 405 1/1990 (DE) .
39 43 330 7/1991 (DE) .
40 16 664 11/1991 (DE) .

* cited by examiner

*Primary Examiner*—Robert J. Sandy
(74) *Attorney, Agent, or Firm*—Wenderoth, Lind & Ponack, L.L.P.

(57) ABSTRACT

A hinge with adjusting devices has a hinge arm with a U-profile that can be secured to a base plate by an intermediate piece, and is connected to a hinge cup by articulated hinge links. The base plate has a mounting plane for abutting a furniture side wall in a mounted position. The position of the hinge arm is adjustable with respect to the base plate in a plane perpendicular to the mounting plane by means of an adjustment screw. Guides are provided for guiding the hinge arm in a direction of the depth of a piece of furniture when the position of the hinge arm is adjusted the adjustment screw. Two intermediate pieces are connected to the hinge arm before the hinge arm is mounted on the base plate. One intermediate piece is fixable to base plate by a spring locking mechanism, ad the other piece is slidably mounted on the first intermediate piece for slidable displacement in the direction of the depth of the piece of furniture.

24 Claims, 14 Drawing Sheets

HINGE

BACKGROUND OF THE INVENTION

The invention relates to a hinge with adjusting devices in which a hinge arm with a profile can be secured to a base plate by means of an intermediate piece and is connected to a second hinge fastening part, for example a hinge cup, by means of articulated hinge links or the like. The base plate has a mounting plane for abutting a furniture side wall in the mounted position, and the position of the hinge arm is adjustable with respect to the base plate in a plane perpendicular to the mounting plane by means of an adjustment screw. Guide means are provided for guiding the hinge arm in a direction of the depth of a piece of furniture when the position of the hinge arm is adjusted by means of said adjustment screw.

With most hinges according to the state of the art the hinge arm is fastened to the base plate by means of a clamping screw or an intermediate piece. To make adjustment of the position of the hinge arm in a direction of the depth of the piece of furniture possible, the clamping screw protrudes through an elongated hole in the hinge arm. The range of adjustment of the hinge arm, in the direction of the depth of the piece of furniture, is defined by the length of this elongated hole.

A further possibility is lateral adjustment of the hinge arm with respect to the base plate, that is, adjustment of the hinge arm in a plane which is perpendicular to the furniture side wall. This lateral adjustment is achieved by an adjustment screw which is screwed into a female thread in the hinge arm and has a head which is anchored in the base plate or an intermediate piece.

Further hinges are known which comprise the hinge arm mounted on an intermediate piece, with the intermediate piece being mounted on the base plate.

An example of such a hinge is shown in the WO 86/02402. When mounting such a hinge it is sufficient to hang the intermediate piece, which is screwed to the hinge arm, onto the base plate and to tilt the hinge arm with the intermediate piece towards the side wall of the piece of furniture, whereby the intermediate piece is automatically stopped on the base plate. The intermediate piece or the base plate are provided with a spring locking mechanism so that mounting and demounting of the hinge arm on the base plate can be done manually without the use of a tool. However, for adjusting the position of the hinge arm with respect to the base plate, a screw driver is needed.

A disadvantage with conventional hinges is that, when the side adjustment screw is turned, the position of the hinges axels on the hinge arm is not only altered laterally with respect to the side wall of the piece of furniture. Because the hinge arm is tilted around its rear end, the hinge axels are also displaced in the direction of the depth of the piece of furniture. Even if this displacement may only be in the range of the millimeter, it can result in non-correct opening and closing of the door.

European patent EP 0 168 731 discloses a hinge whereby guides are provided for the hinge arm so that, during lateral adjustment of the hinge arm relative to the position of the hinge axels on the hinge arm, the position is automatically corrected with respect to the direction of the depth of the piece of furniture so that in the end these hinge axels remain in the same position with respect to the direction of the depth of the piece of furniture. The base plate is made of two pieces. The hinge arm of this hinge can only be mounted on the two part base plate specially provided for this hinge.

SUMMARY OF THE INVENTION

It is the object of the present invention to improve a hinge of the afore-mentioned kind in such a way that the hinge arm does not have to be mounted on a base plate specially provided for the hinge arm. For example, it should be possible to mount the hinge arm manually without the use of a tool on a base plate as used with a hinge according to the WO 86/02402.

According to the invention, this is achieved in that two intermediate pieces are connected to the hinge arm before the hinge arm is mounted on the base plate together with the two intermediate pieces. One of the intermediate pieces is fixable to the base plate by means of a spring locking mechanism, and the other intermediate piece is slidably mounted on the first intermediate piece for slidable displacement in the direction of the depth of a piece of furniture.

A further embodiment of the invention provides that both intermediate pieces have a U-profile in cross section and one intermediate piece is inserted into the other.

A further embodiment of the invention provides that the intermediate piece which is fixed to the base plate carries a pin which is parallel to the axis of the hinge. The pin protrudes through slots in the side web of the second intermediate piece and through slots in the side webs of the hinge arm.

A further embodiment of the invention provides that a tongue projects from the middle web of the hinge arm, the tongue being guided in a slot of one of the intermediate pieces.

A further embodiment of the invention provides that at least one pivot lever is provided which is pivoted on one end to one of the intermediate pieces and on the other end to the hinge arm. The pivot lever is pivoted when the adjustment screw for lateral adjustment of the hinge arm is turned.

BRIEF DESCRIPTION OF THE DRAWINGS

The invention will now be described in more detail by way of example only with reference to the accompanying drawings, wherein.

DESCRIPTION OF THE PREFERRED EMBODIMENTS

Figure 1:
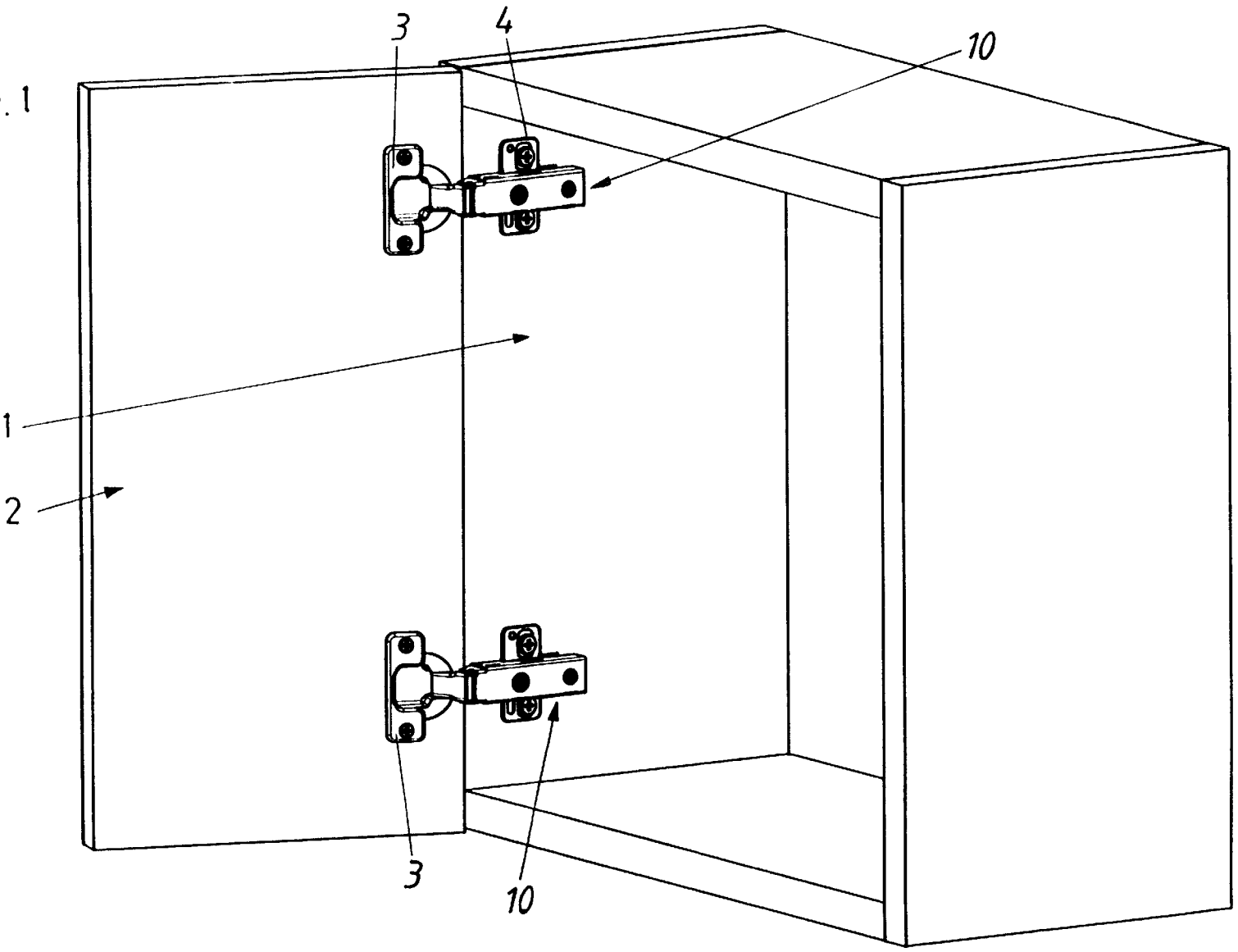
FIG. 1 is a perspective view of a piece of furniture with a door, the door being mounted to the furniture side wall by means of two hinges.

For mounting a door 2 on a furniture side wall 1 first base plate 4 is mounted on the furniture side wall 1 in such a way that the mounting plane 55 of the base plate 4 abuts the furniture side wall 1. The hinge cup 3 is inserted into a bore 27 in the door 2. The hinge cup 3 is hinged to a hinge arm 10 by means of articulated hinge links 23. The hinge links 23 are pivoted to hinge axles 24 of the hinge arm 10 and hinge axles 26 of the hinge cup 3.

Two intermediate pieces 5, 17 are held within the U-profile of the hinge arm 10.

The intermediate piece 5 is at its front end, that is, the end nearest to the hinge axis, provided with a pin 6 which is held in a recess 14 of the base plate 4, when the intermediate piece 5 is mounted on the base plate 4. When mounting the door 2, the intermediate piece 5, which is fastened to the hinge arm 10 together with the intermediate piece 17, is anchored to the base plate 4 by placing the pin 6 into the recess 14, whereby the hinge arm 10 is held at an angle to the base plate 4 and the furniture side wall 1.

Figure 2:
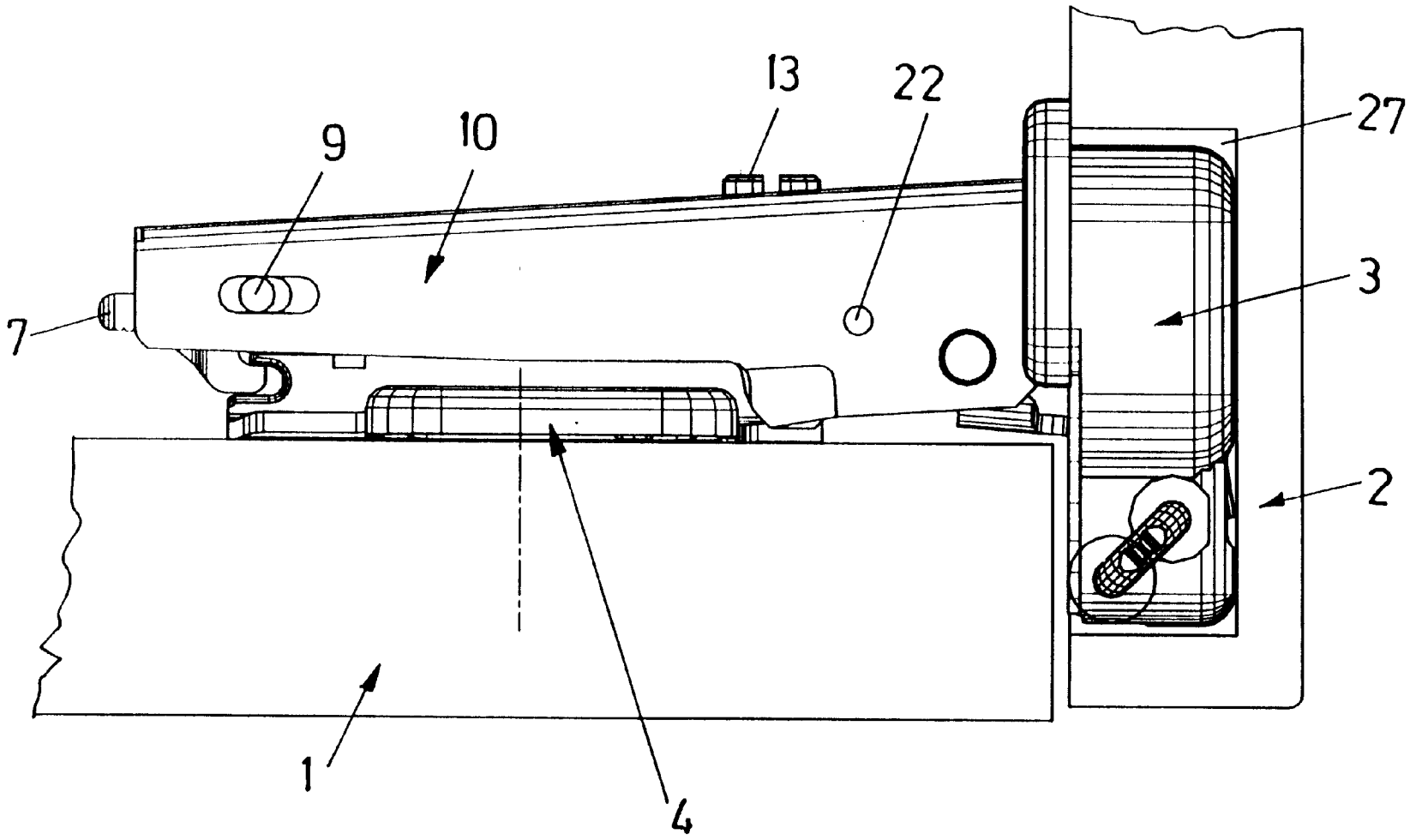
FIG. 2 is a side view of a hinge mounted to a furniture side wall and to a door.

Thereafter, the hinge arm 10, together with the intermediate pieces 5, 17, is pivoted into the position shown in FIG. 2, whereby a tilting lever 7, which is acted upon by a spring 8 automatically engages in a notch 25 of the base plate 4.

Approximately in the middle of the intermediate piece 5 is provided locking bolt 11, which is held in notch 12 when the hinge arm 10 is mounted on the base plate 4. By means of the locking bolt 11 and the notch 12 the intermediate piece 5 is held on the base plate 4 without clearance. In WO 86/02402, the mounting of the intermediate piece 5 on the base plate 4 is described in detail.

Figure 6:
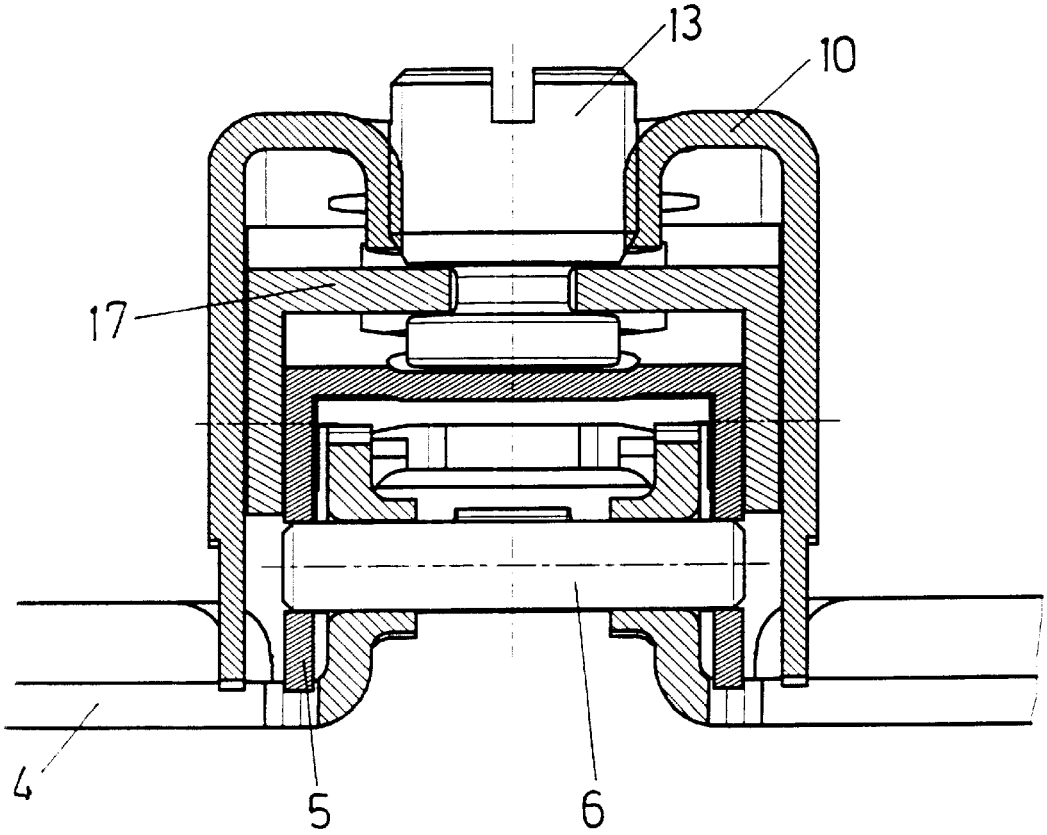
FIG. 6 is a cross section through the parts of the hinge mounted on the furniture side wall taken in the area of an adjusting screw for lateral adjustment.

The hinge arm 10 is provided with a female thread in which adjustment screw 13, for lateral adjustment of the hinge arm 10, is screwed. In the embodiment shown in FIGS. 3 and 6, the intermediate pieces 5 and 17, as well as the hinge arm 10, have a U-profile in cross section, whereby the intermediate piece 5 is inserted into the intermediate piece 17 and both intermediate pieces 5, 17 are inserted into the hinge arm 10. The intermediate piece 17, which is suitable between the hinge arm 10 and the intermediate piece 5, is provided at its front end with a slot 31 which is opened to the front end of the intermediate piece 17. The adjustment screw 13 has a head 16 and a shaft 15 which protrudes through the slot 31 so that the adjustment screw 13 is anchored in the intermediate piece 17 by its head 16.

The intermediate piece 5 is provided with a recess 32 so that the head 16 of the adjustments screw 13 abuts the bottom of the recess 32.

The tilting lever 7 is mounted on an axle 9 and is acted upon by spring 8.

The axle 9 is mounted in holes 28 of the intermediate piece 5 and protrudes through slots 29 of the intermediate piece 17 as well as through slots 30 in the hinge arm 10. The slots 29 in the intermediate piece 17 are opened towards the rear of the intermediate piece 17.

The axle 9 not only serves for mounting the pivot lever 7, but also for retaining both intermediate pieces 5, 17 in the hinge arm 10.

Near the front end of the intermediate piece 17, bayonet-type slots 34 are provided in the side webs of the intermediate piece 17. Pegs 35 provided on the side webs of the intermediate piece 5 protrude into the slots 34.

The intermediate piece 17 is held on the intermediate piece 5 in such a way that it can be moved over the length of the slots 29, 34 with respect to the intermediate piece 5. Movement of the intermediate piece 17 is parallel or approximately parallel to the mounting plane 55 of the base plate 4.

An eccentric 18 is mounted in the intermediate piece 5. The eccentric 18 protrudes into an elongated hole 19 in the intermediate piece 17. The elongated hole 19 is aligned parallel to the axes of the hinge.

By turning the eccentric 18 the position of the hinge arm 10 is adjusted in the direction of the depth of the piece of furniture. During this adjustment the intermediate piece 17 is also moved in the direction of the depth of the piece of furniture with respect to the intermediate piece 5. The hinge arm 10 is provided with an opening which makes it possible to turn the eccentric 18 with a screw driver.

Figure 3:
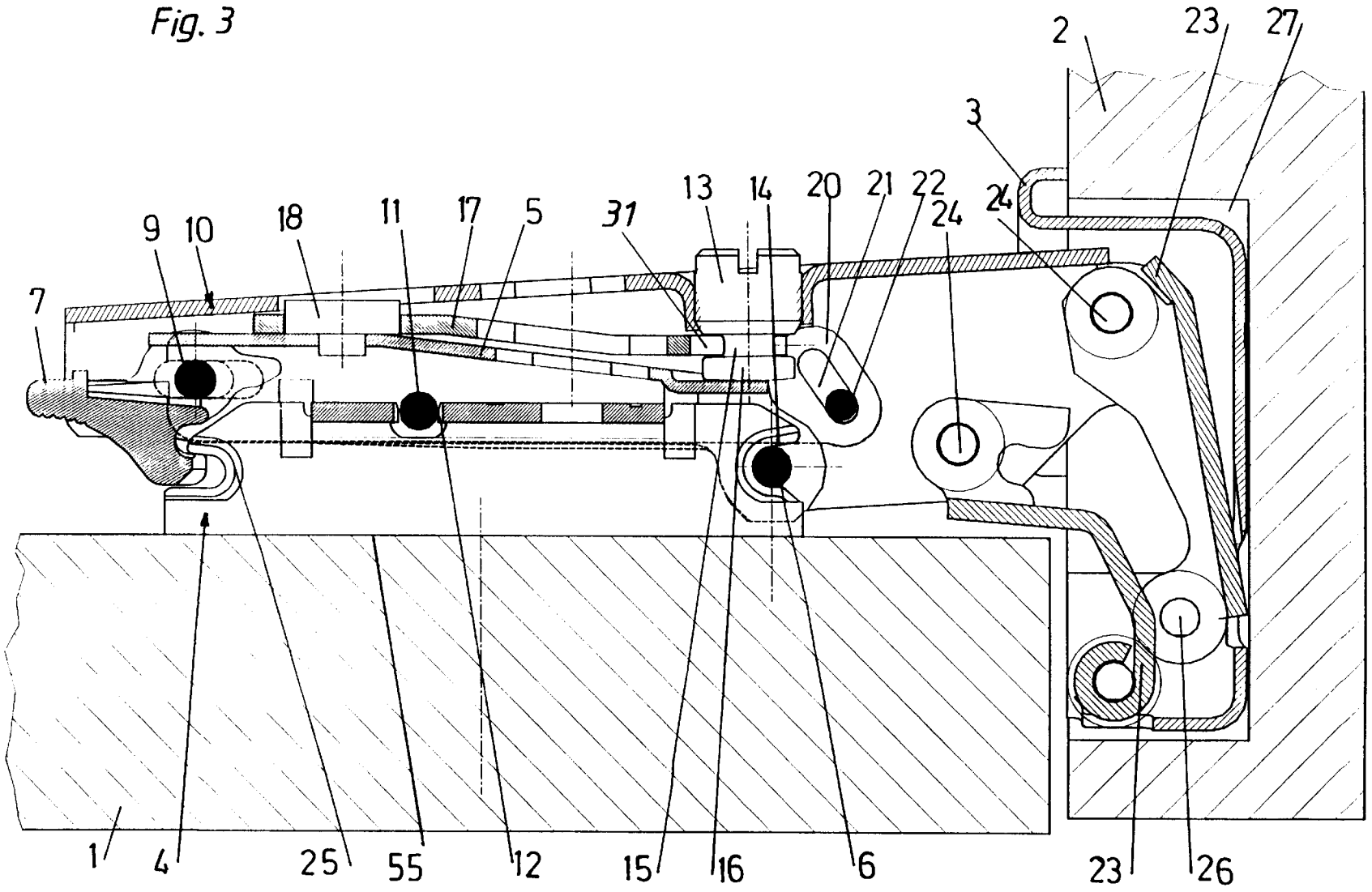
FIG. 3 is a longitudinal section through a hinge take in a plane perpendicular to the furniture side wall and to the door.
Figure 4:
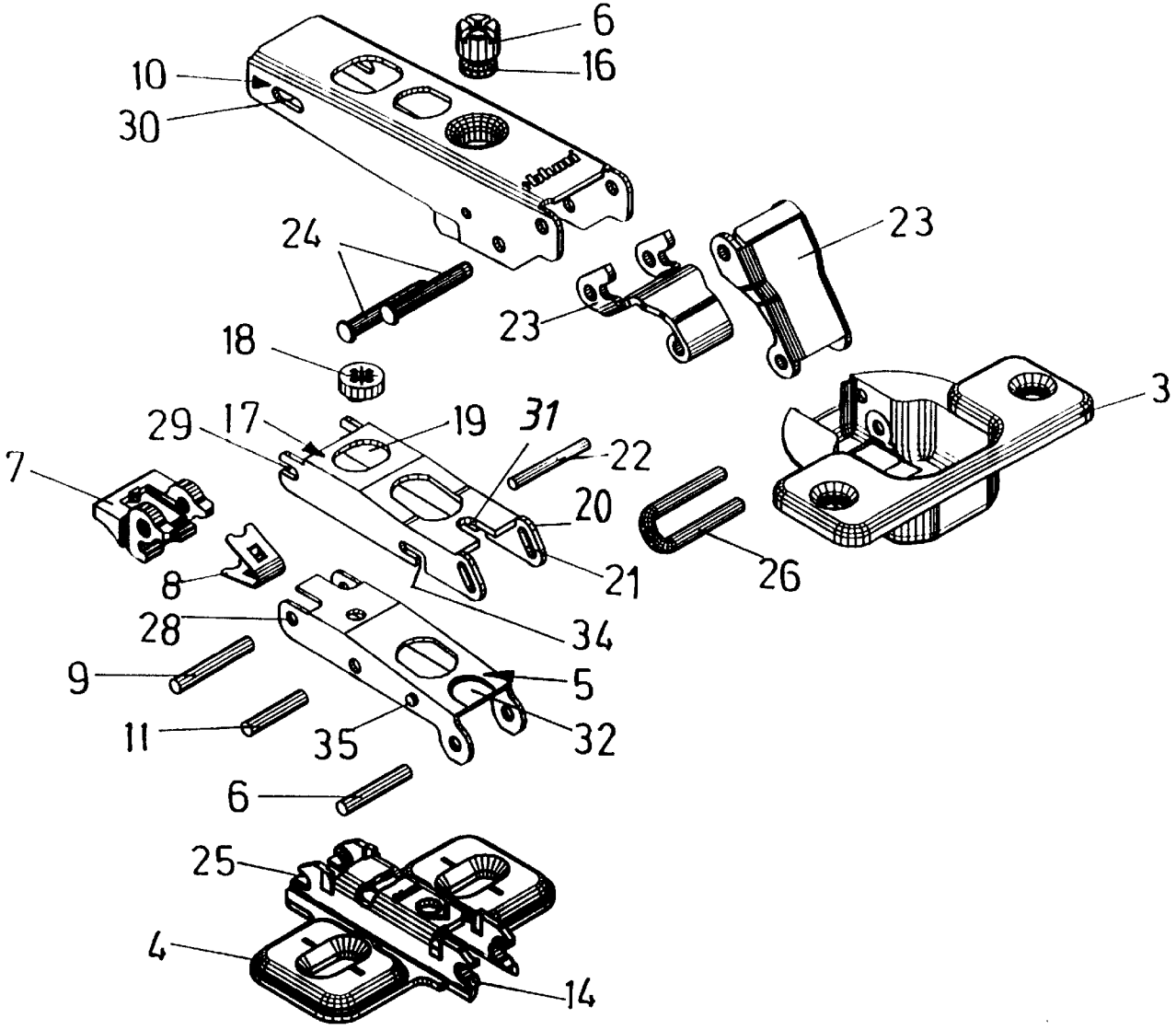
FIG. 4 is an exploded perspective view of a hinge according to the invention.
Figure 5:
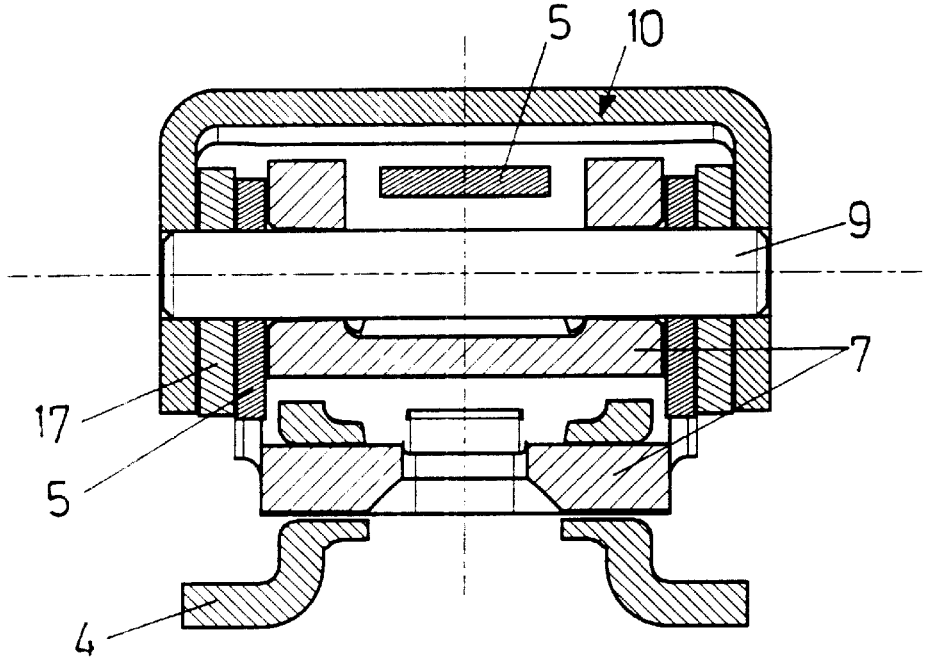
FIG. 5 is a cross section through the parts of the hinge mounted to the furniture side wall in the rear area of the hinge arm.

At its front end, that is the end nearest to the hinge axis, the intermediate piece 17 is provided with two lateral flaps 20. The flaps 20 are provided with longitudinal slots 21 which are inclined toward the mounting plane 55 of the base plate 4 (FIG. 3).

A pin 22 which is held in the lateral webs of the hinge arm 10 protrudes into these slots 21. If the adjustment screw 13 is turned the hinge arm 10 is tilted around its rear end. Because of this the hinge axles 24 are not only displaced in a direction perpendicular to the furniture side wall 1, but also in a direction of the depth of the piece of furniture. Thereby the distance between the door 2 and the front face of the furniture side wall 1 is altered. If the hinge arm 10 was in a correct position with respect to the depth of the piece of furniture before its lateral positioning, then this correct position is disturbed. With most hinges it is therefore necessary to readjust the position of the hinge arm in a direction of the depth of the piece of furniture after lateral adjustment of the hinge arm.

With a hinge according to the invention, turning of the adjustment screw 13 also results in a translational motion of the hinge arm 10 with respect to the furniture side wall 1. This sliding motion occurs because of the guidance provided by the pin 22 and the slots 21 at the front of the intermediate piece 27 and the pin 9 and the slots 30 at the rear of the intermediate piece 17.

In the embodiment according to FIGS. 7 to 14, the intermediate piece 17 is plate shaped. Again the intermediate piece 5 is held on the base plate 4 by an axle 6 at its front end and by means of a tilting lever 7 at its rear end.

As in the previously described embodiment, the intermediate piece 5 is provided with an open slot 31 at its front end. The adjustment screw 13 is inserted in the slot 31 with its shaft 15. The head 16 of the adjustment screw 13 abuts the intermediate piece 5.

Figure 9:
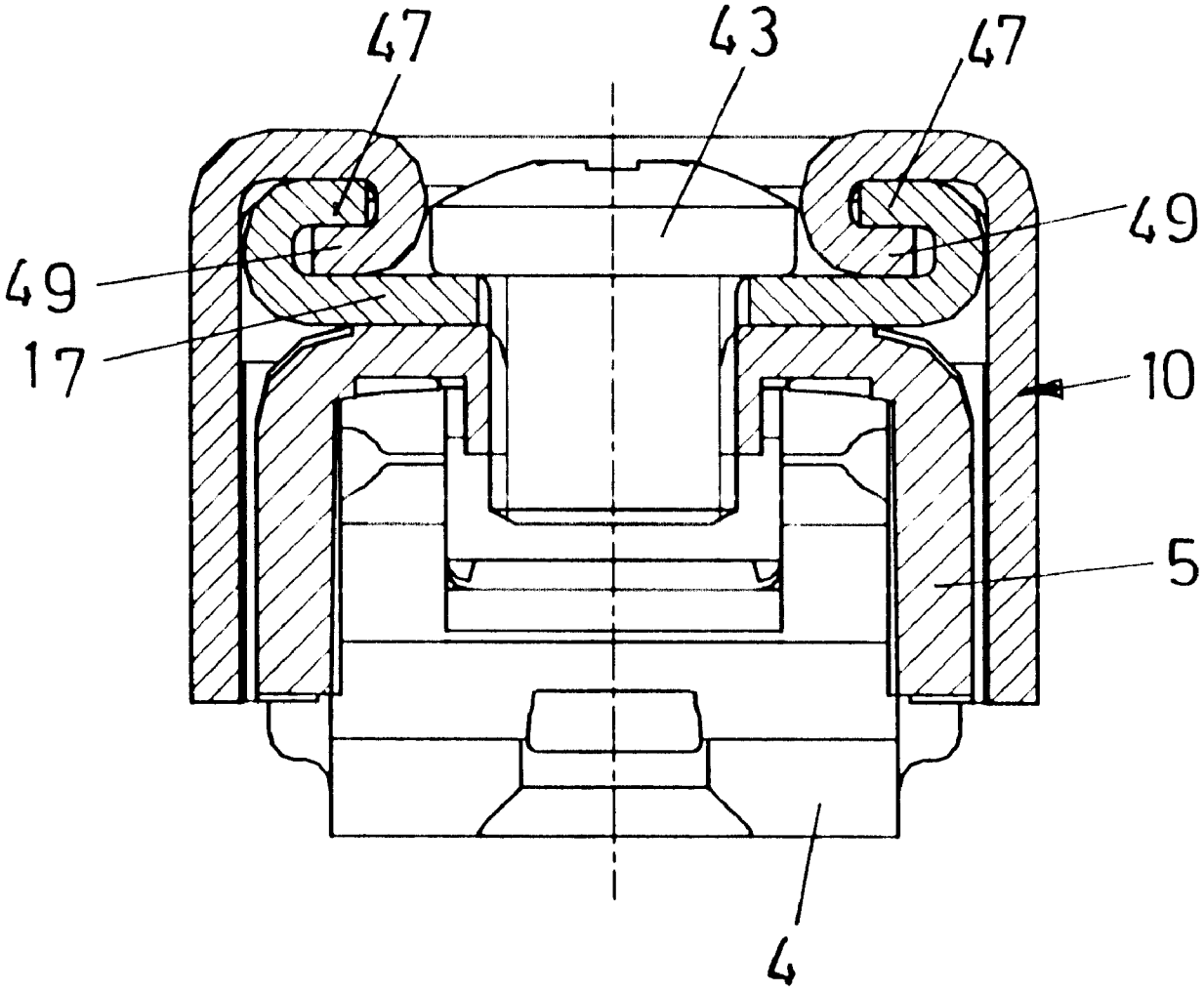

Near its rear end the intermediate piece 17 is provided with hooks 47 which engage with hooks 49 of the hinge arm 10 (FIG. 9).

A clamping screw 43 extends through an elongated hole 44 in the hinge arm 10 and through an elongated hole 46 in the intermediate piece 17 and is held in a female thread 48 of the intermediate piece 5.

The intermediate piece 17 is also provided with an elongated hole 45 through which the adjustment screw 13 extends so that sliding movement of the intermediate piece 17 is not impeded by the adjustment screw 13.

At its front end the intermediate piece 17 is provided with an angular flap 40. In the flap 40 there is a slot 41 which is aligned parallel to the axis of the hinge. The flap 40 is bent in a direction toward the middle web of the hinge arm 10.

Figure 7:
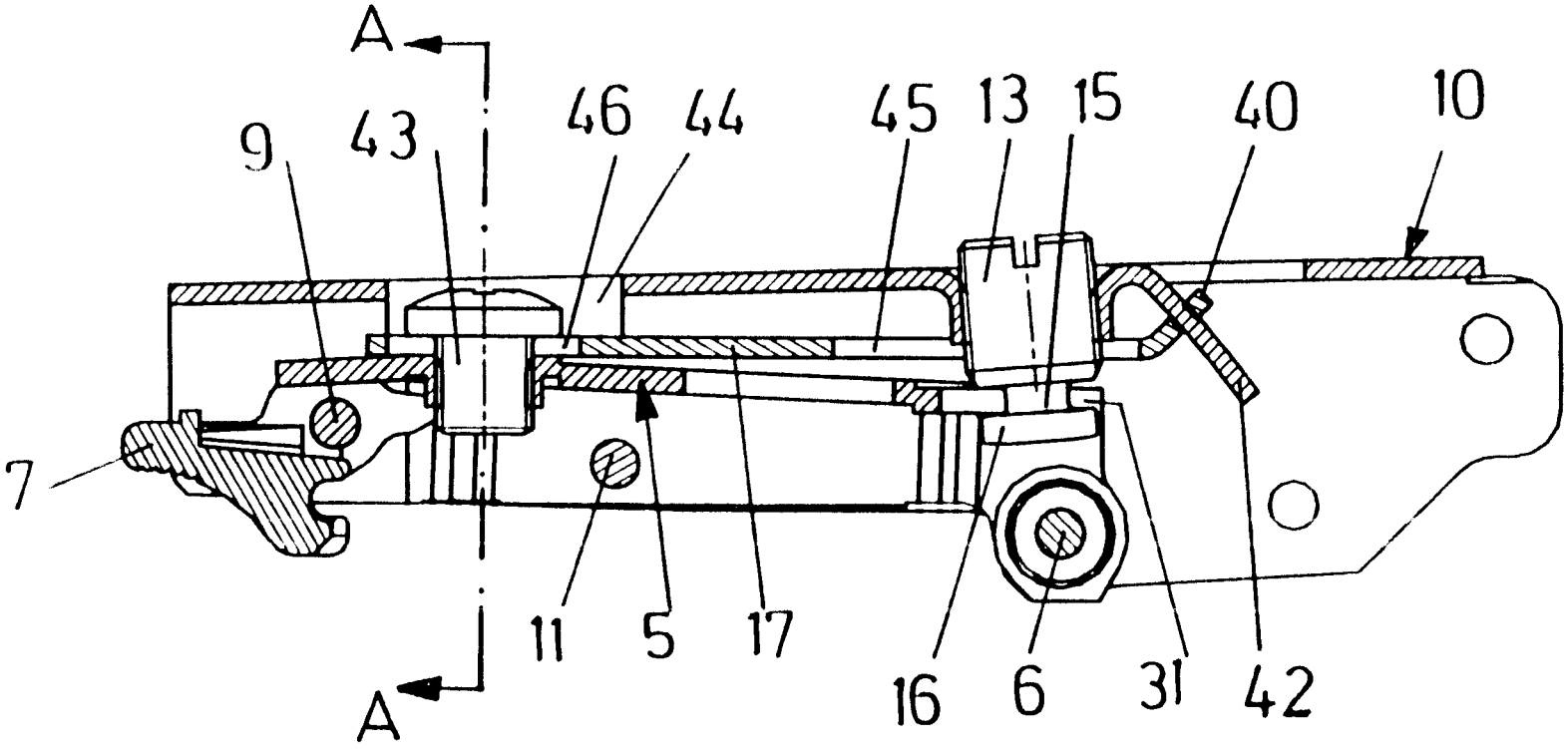
FIG. 7 is a longitudinal section through a hinge arm and intermediate pieces according to a further embodiment of the invention.
Figure 8:
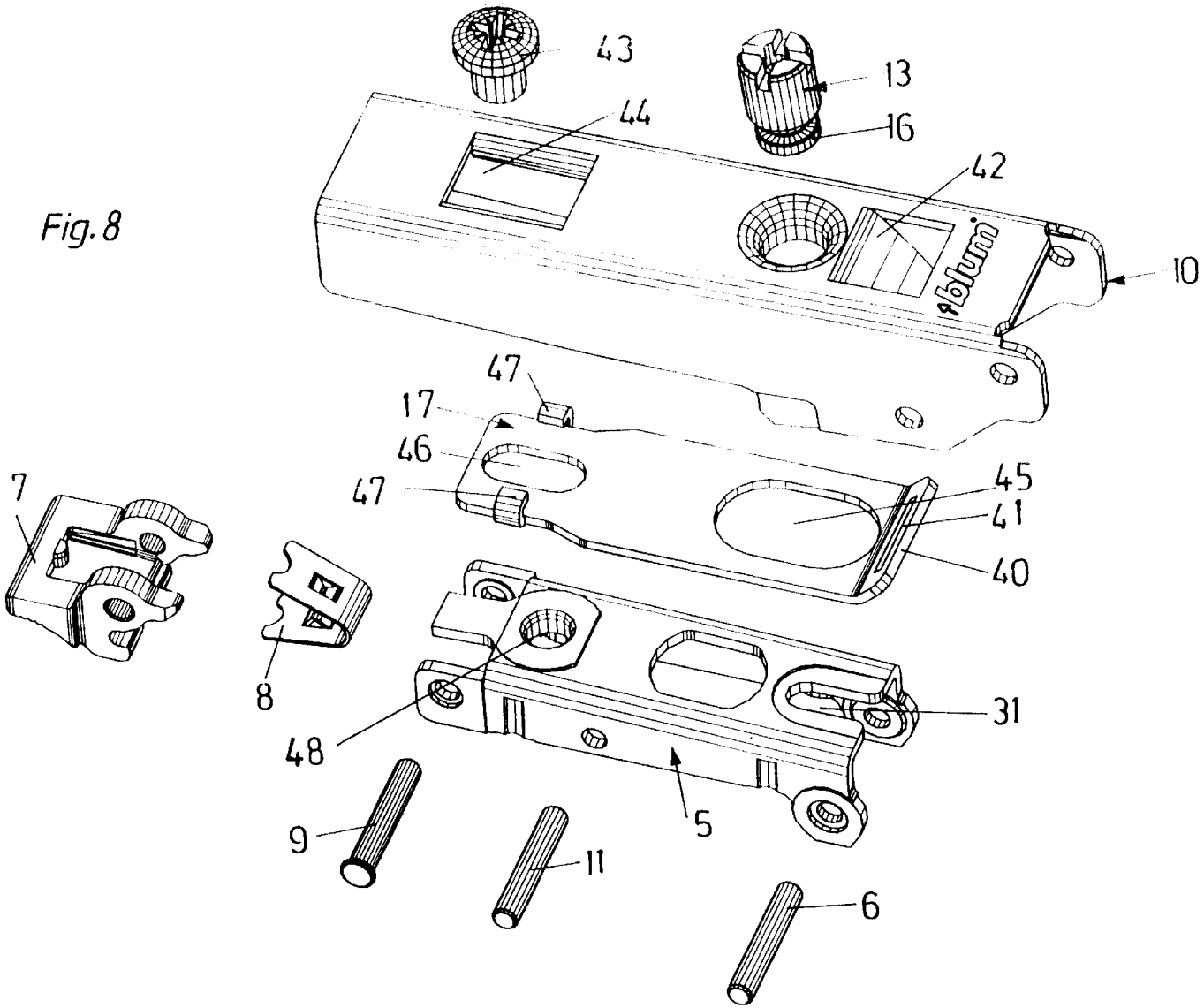
FIG. 8 is an exploded perspective view of the parts shown in FIG. 7, FIG. 9 a cross section through a hinge arm and intermediate pieces taken in the area of an adjustment screw for adjusting this hinge arm in the direction of the depth of the piece of furniture.

A tongue 42 is stamped out of the middle web of the hinge arm 10. The tongue 42 engages in the slot 41 of the flap 40 (FIG. 7). The tongue 42 and the flap 40 with the slot 41 are the guiding means for the hinge arm 10 when the adjustment screw 13 is turned.

In the embodiment of FIGS. 8 to 11 the position of the hinge arm 10 with respect to the depth of the piece of furniture can be adjusted manually after the clamping screw 43 has been loosened.

Figure 11:
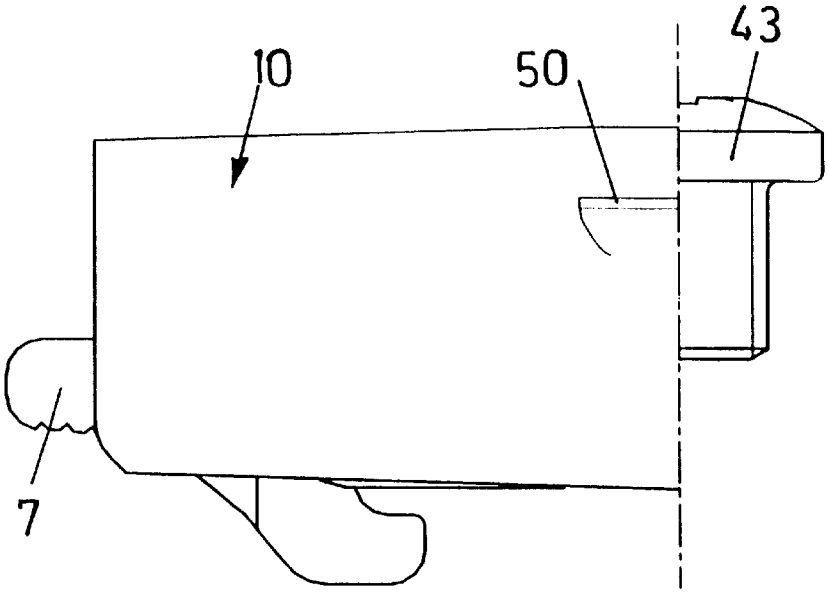
FIG. 11 is a side view of the rear end of the hinge arm.
Figure 10:
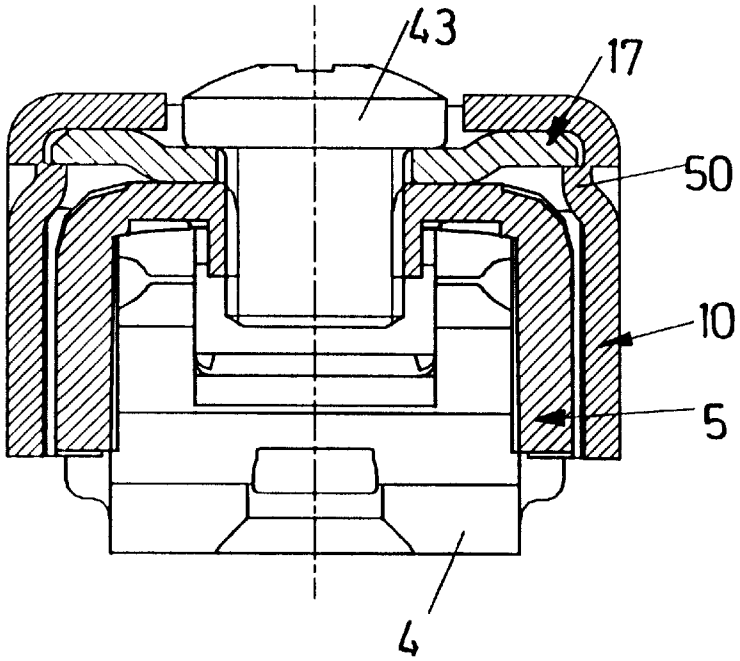
FIG. 10 is a cross section of a hinge arm and the intermediate pieces taken in the area of an adjustment screw for adjusting the hinge arm in the direction of the depth of the piece of furniture according to a further embodiment of the invention.

FIGS. 10 and 11 show a different version of the rear guiding means for the intermediate piece 17. Instead of the hooks 47 and 49, the hinge arm 10 is provided with nubs 50, which are stamped out of the lateral webs of the hinge 10. The nubs 50, together with a middle web of the hinge arm 10, are the guiding means for the plate like intermediate piece 17 (FIG. 10, FIG. 11).

Figure 12:
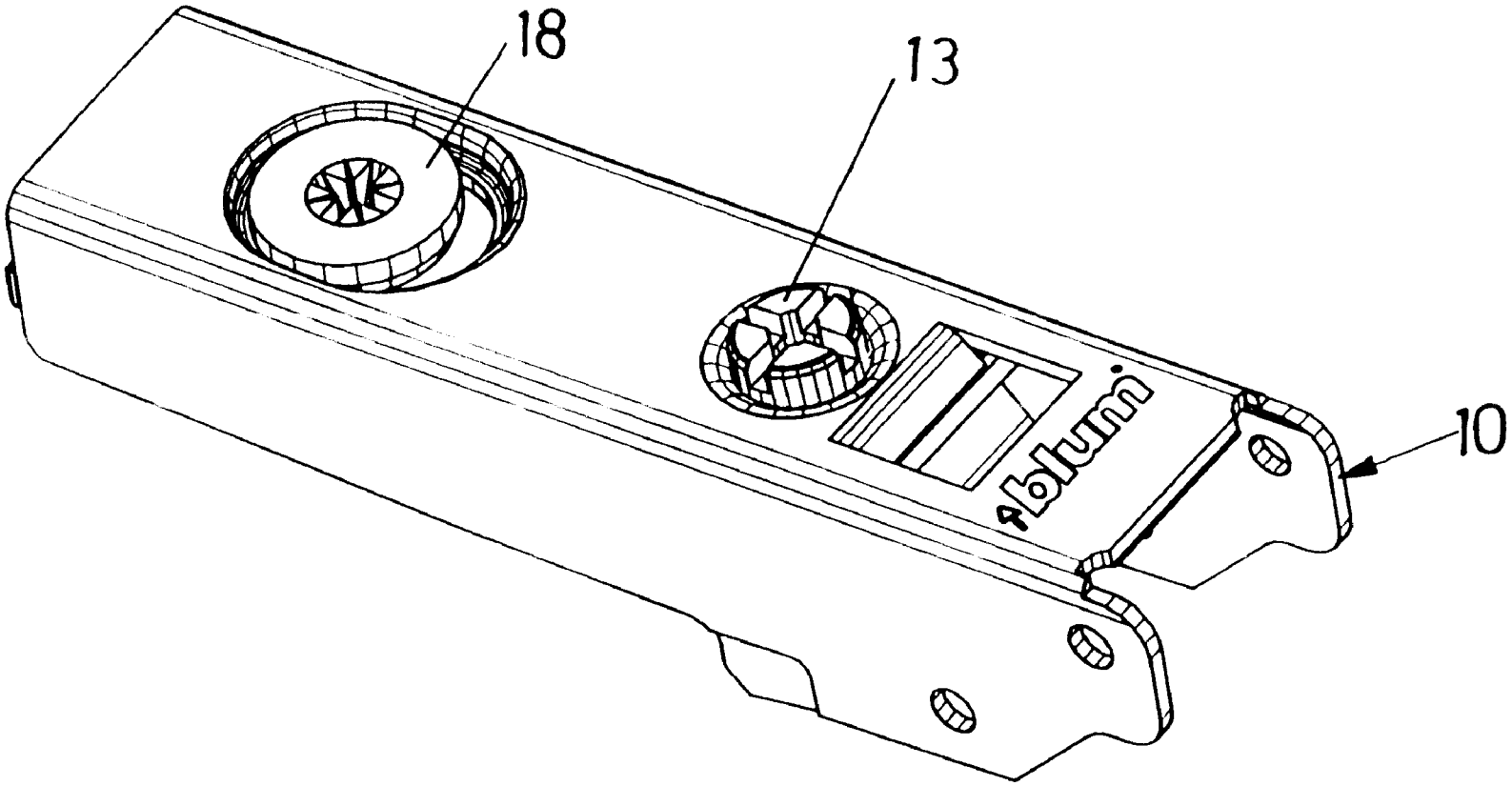
FIG. 12 is a perspective view of a hinge arm according to the invention.
Figure 13:
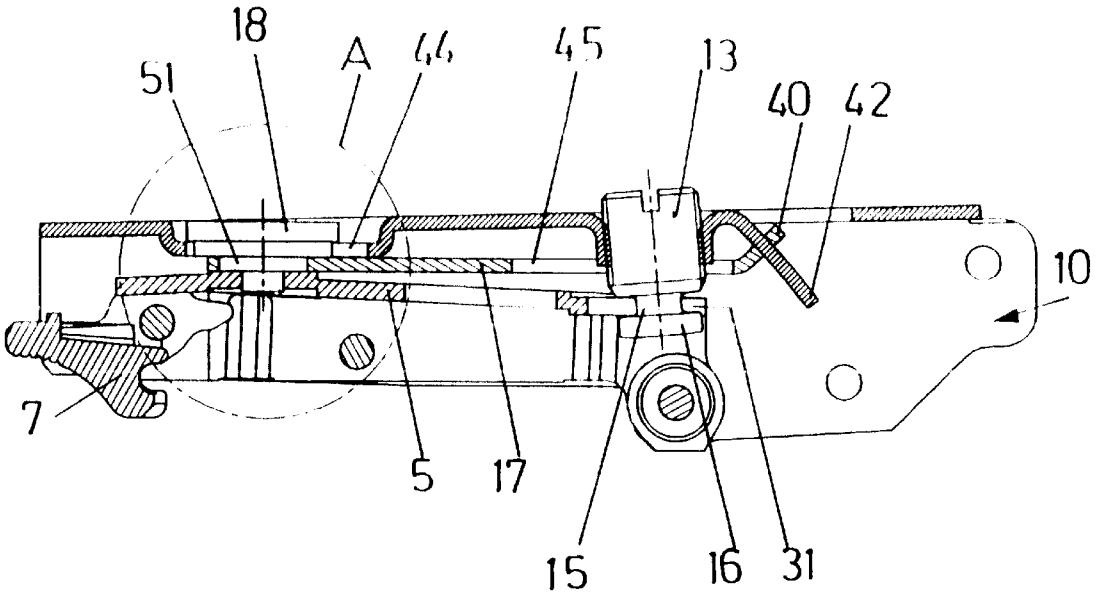
FIG. 13 is a longitudinal section through the hinge arm and intermediate pieces.
Figure 13A:
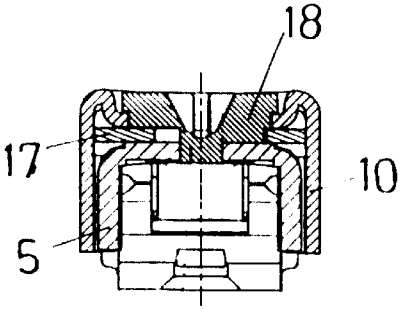
FIG. 13*a* shows detail A of FIG. 13.
Figure 14:
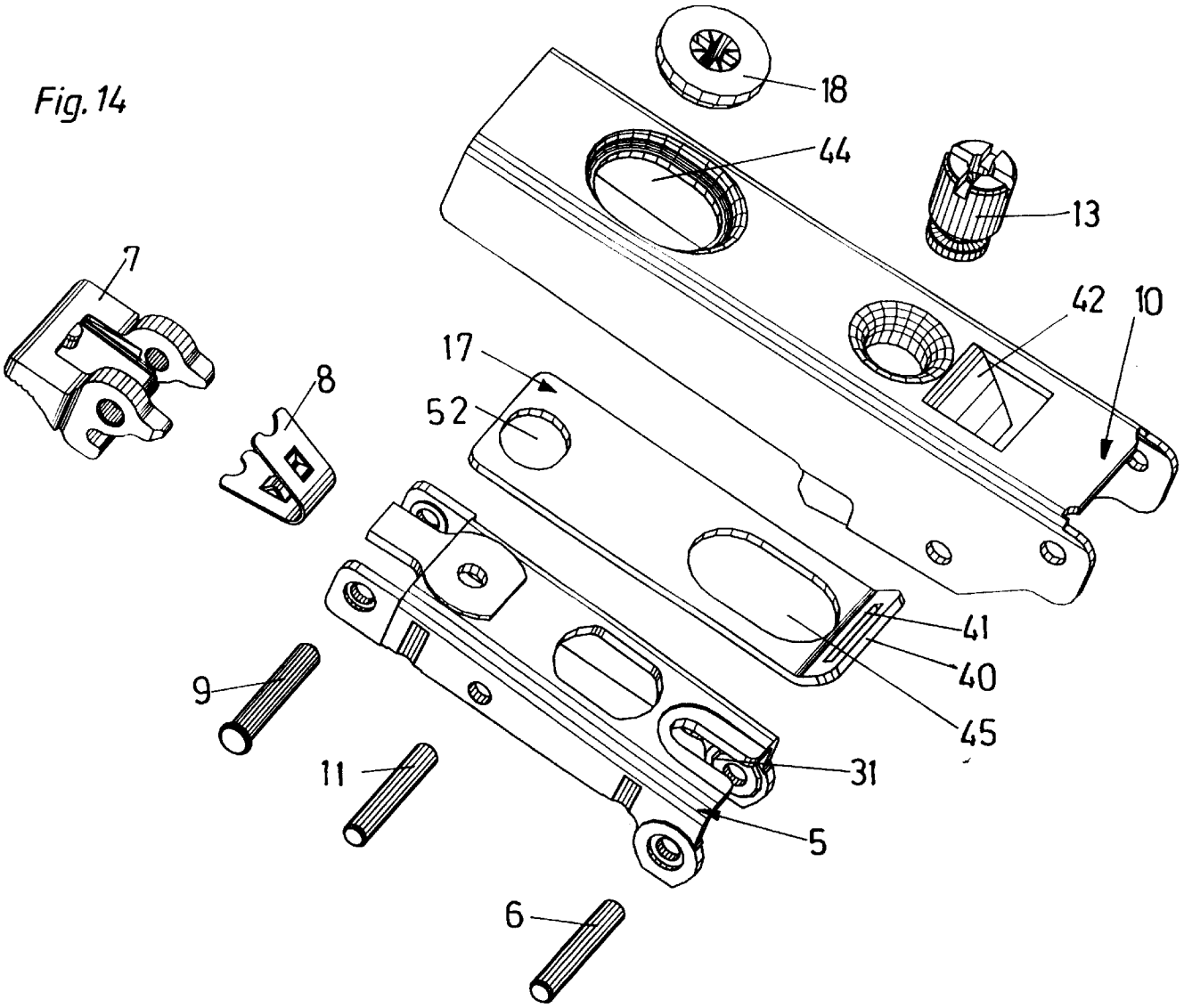
FIG. 14 shows an exploded perspective view of the hinge arm, the intermediate pieces and associated parts.

In the embodiment of FIGS. 12 to 14 the adjustment of the position of the hinge arm 10 in the direction of the depth of the piece of furniture is again effected with an eccentric 18 mounted to the intermediate piece 5.

The eccentric 18, which extends through a hole 44 in the hinge arm 10, has a cam 51 which is situated in an elongated hole 52 of the intermediate piece 17.

By turning the eccentric 18, the intermediate piece 17 is moved in a longitudinal direction of the hinge arm 10, whereby the intermediate piece 17 moves the hinge arm 10, which is coupled to the intermediate piece 17 by means of the tongue 42 engaging the slot 41 of the flap 40 of the intermediate piece 17.

When the adjustment screw 13 is turned the hinge arm 10 is moved by the intermediate piece 17, whereby the tongue 42 shifts the intermediate piece 17.

Figure 15:
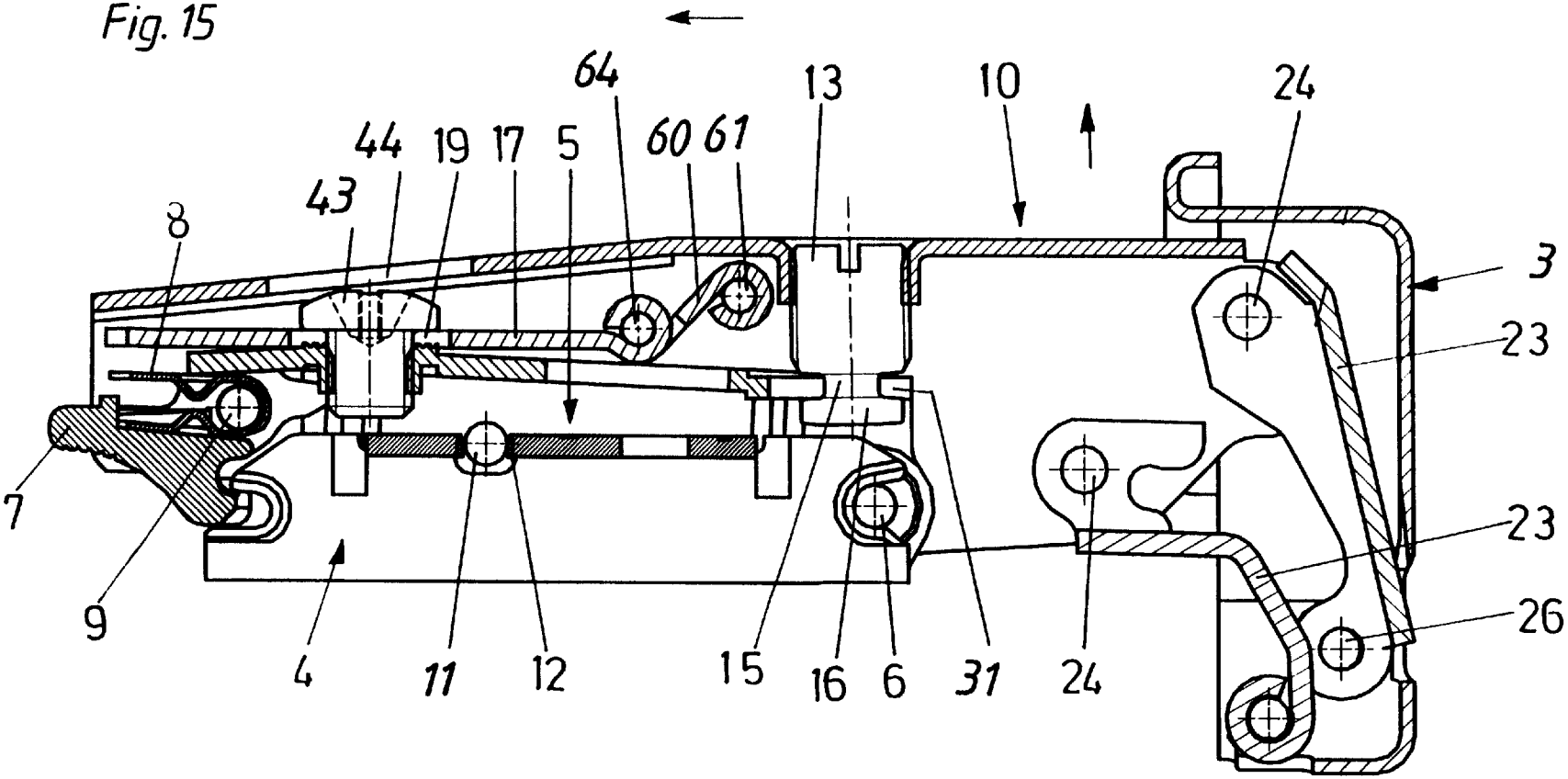
FIG. 15 is a longitudinal section through a further embodiment of a hinge according to the invention in a closed position.
Figure 16:
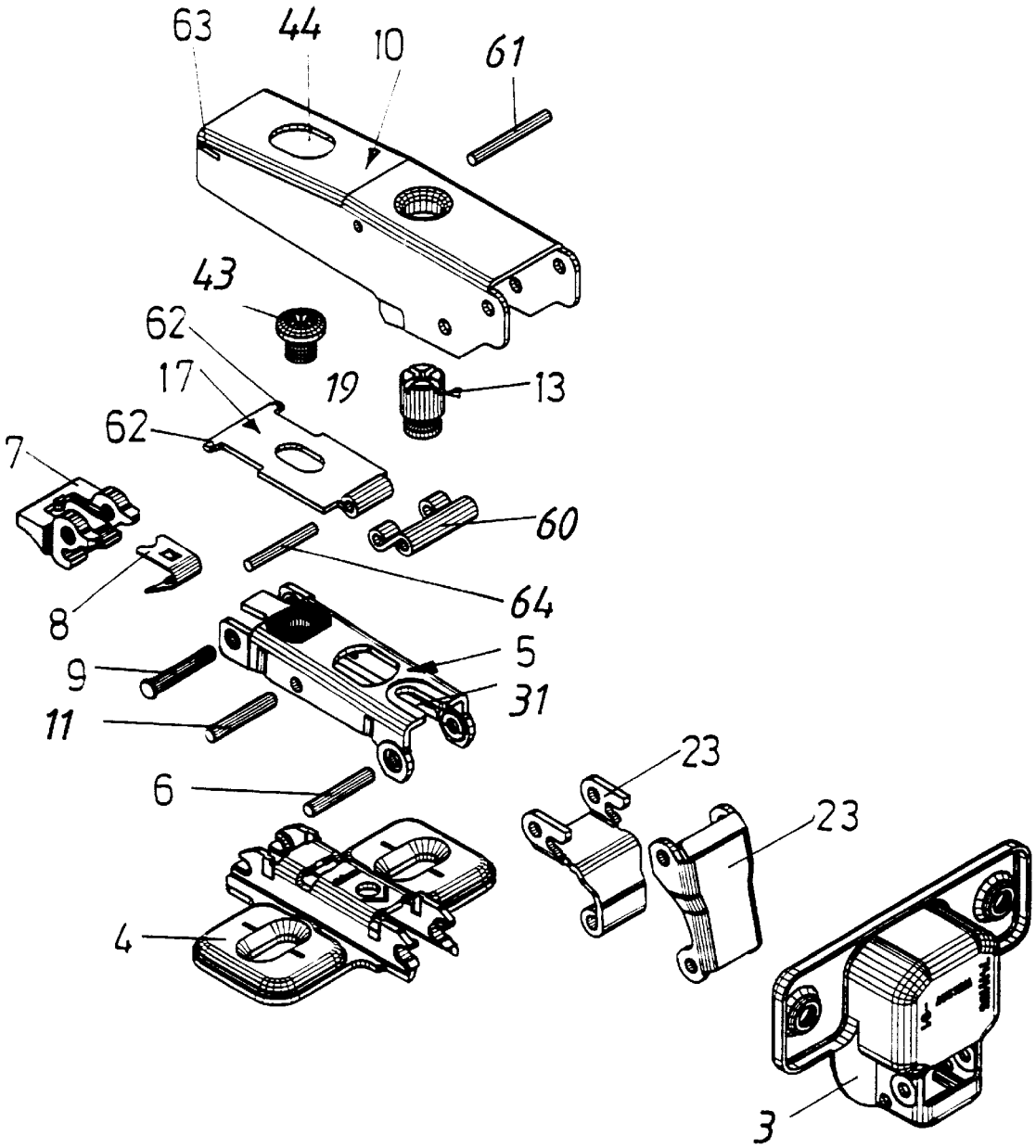
FIG. 16 is an exploded perspective view of the hinge according to FIG. 15.

In the embodiment of FIGS. 15 and 16, again an intermediate piece 17 is provided which is held on the intermediate piece 5 by means of the adjustment screw 13 and the clamping screw 43. The clamping screw 43 protrudes through a slot 19 in the intermediate piece 17. The intermediate piece 17 is linked to the hinge arm 10 by means of a pivot lever 60. The pivot lever 60 is pivotally mounted on an axle 61 on the hinge arm 10 and an axle 64 on the intermediate piece 17.

At is rear end the intermediate piece 17 is provided with lateral protrusions 62 which engage in slots 63 in the lateral webs of the hinge arm 10.

When the adjustment screw 13 is turned the hinge 10 is tilted slightly around its rear end. According to the invention turning of the adjustment screw 13 also pivots the pivot lever 60 so that hinge arm 10 is moved linearly in the direction of the depth of the piece of furniture. This linear movement of the hinge arm 10 makes up for the displacement of the axles 24 in the direction of the depth of the piece of furniture which is due to the tilting of a hinge arm. With a hinge according to the invention, it is not necessary to readjust the position of the axles 24 with respect to the depth of the piece of furniture after lateral adjustment of the hinge arm.

If the adjustment of the position of the hinge arm 10 in the direction of the depth of the piece of furniture is necessary, the clamping screw 43 is loosened and the hinge arm can be moved manually together with the intermediate piece 17 over the length of the elongated hole 19 in the direction of the depth of the piece of furniture.

The hinge arm 10 is provided with an elongated hole 44 which makes it possible to reach the clamping screw 43 with a screw driver.

In both cases, turning of the adjustment screw 13 for lateral adjustment of the door 2 results in the following movement of the hinge arm 10.

If the front end of the hinge arm 10 is moved away from the furniture side wall 1 by means of the adjustment screw 13, the hinge arm 10 is also moved linearly towards the rear of the piece of furniture. Reverse turning of the adjustment screw 13 effects movement of the hinge arm 10 towards the front of the piece of furniture.

Linear movement in the direction of the depth of the piece of furniture of the hinge arm 10, as a result of the lateral adjustment of the door 2, is only in the range of a millimeter, but it is sufficient to correctly position th axels 24 of the hinge links 23 on the hinge arm 10.

What is claimed is:

1. A hinge, comprising:

a hinge arm;

a base plate to which said hinge arm can be secured, said base plate having a mounting plane for abutting a furniture side wall of a piece of furniture in a mounted position;

a hinge fastening part, said hinge arm being connected to said hinge fastening part by hinge members;

an adjustment screw to adjust the position of said hinge arm with respect to said base plate in a plane perpendicular to said mounting plane; and two intermediate pieces to be connected to said hinge arm, a first intermediate piece of said two intermediate pieces being fixable to said base plate and a second intermediate piece of said two intermediate pieces being slidably mounted on said first intermediate piece for slidable displacement in the direction of depth of the piece of furniture; and a guide for guiding said hinge arm in a direction of the depth of the piece of furniture when the position of said hinge arm is adjusted by said adjustment screw.

2. The hinge of claim 1, wherein:

said hinge arm has a U-profile;

said hinge fastening part comprises a hinge cup;

said hinge members comprise articulated hinge links;

said first intermediate piece having a spring locking mechanism for fixing said first intermediate piece to said base; and said first and second intermediate pieces being connected to said hinge arm before said hinge arm is mounted on said base plate.

3. The hinge of claim 1, wherein said hinge arm has a U-profile, and said first and second intermediate pieces have a U-profile in cross section, with one of said two intermediate pieces being inserted into the other.

4. The hinge of claim 3, wherein bayonet slots are provided in side webs of said second intermediate piece and pegs protrude from side webs of said first intermediate piece and engage in said bayonet slots.

5. The hinge of claim 1, wherein said hinge fastening part comprises a hinge cup and said hinge members comprise articulated hinge links.

6. The hinge of claim 1, wherein said first intermediate piece has a spring locking mechanism for fixing said first intermediate piece to said base and said first and second intermediate pieces are connected to said hinge arm before said hinge arm is mounted on said base plate.

7. The hinge of claim 1, wherein a pin is mounted on said first intermediate piece, said pin being parallel to an axle of said hinge and protruding through slots in side webs of said second intermediate piece and slots in side webs of said hinge arm.

8. The hinge of claim 7, wherein said slots in said second intermediate piece are open towards the rear of said intermediate piece.

9. The hinge of claim 1, wherein said adjustment screw is held by said second intermediate piece.

10. The hinge of claim 1, wherein said adjustment screw abuts said first intermediate piece.

11. The hinge of claim 1, wherein said guide comprises a tongue protruding from said hinge arm into a slot in one of said two intermediate pieces.

12. The hinge of claim 11, wherein said slot is parallel to an axis of said hinge.

13. The hinge of claim 11, wherein said slot is in a flap that protrudes from the one of said two intermediate pieces towards a door position of the piece of furniture and a middle web of said hinge arm.

14. The hinge of claim 11, wherein said tongue is situated next to said adjustment screw.

15. The hinge of claim 11, wherein:

said first intermediate piece is anchored to said base plate at front and rear ends of said first intermediate piece;

said slot is formed in a flap of said second intermediate piece; and said tongue and said flap are situated between said front end of said first intermediate piece and hinge axles of said hinge arm.

16. The hinge of claim 11, wherein said tongue is stamped out of a middle web of said hinge arm.

17. The hinge of claim 11, wherein said tongue is directed towards the mounting plane of said base at an angle of between 45 and 55 degrees.

18. The hinge of claim 1, wherein an eccentric is mounted on said first intermediate piece, said eccentric extending through a longitudinal slot in said second intermediate piece, and said longitudinal slot being parallel to the axis of said hinge.

19. The hinge of claim 1, wherein said second intermediate piece is slidable in the direction of depth of the piece of furniture by turning said adjustment screw to adjust the position of said hinge arm with respect to said base plate in the plane perpendicular to said mounting plane.

20. The hinge of claim 1, wherein a pivot lever is pivoted at one end thereof to said hinge arm and at an other end thereof to one of said two intermediate pieces.

21. The hinge of claim 20, wherein the one of said two intermediate pieces is said second intermediate piece.

22. The hinge of claim 21, wherein said first intermediate piece comprises a female thread having a clamping screw screwed therein for clamping said second intermediate piece.

23. The hinge of claim 20, wherein said pivot lever is a one armed lever.

24. The hinge of claim 20, wherein said hinge arm is mounted on the one of said two intermediate pieces.

* * * * *